United States Patent [19]

Baston

[11] Patent Number: 5,007,501

[45] Date of Patent: Apr. 16, 1991

[54] APPARATUS FOR FACILITATING THE INTERNAL INSPECTION AND REPAIR OF LARGE PRESSURE VESSELS

[76] Inventor: Peter J. Baston, 1450 Meadowood Village Dr., Ft. Worth, Tex. 76120

[21] Appl. No.: 402,836

[22] Filed: Sep. 1, 1989

[51] Int. Cl.[5] ..... E04G 3/10; E04G 3/14

[52] U.S. Cl. ..... 182/128; 182/142; 182/222

[58] Field of Search ..... 182/128, 142–144, 182/223, 222

[56] References Cited

U.S. PATENT DOCUMENTS

| | | | |
|---|---|---|---|
| 1,244,670 | 10/1917 | Whitney . | |
| 1,713,956 | 5/1929 | Diven . | |
| 3,168,163 | 2/1965 | Prosser | 182/128 |
| 3,850,596 | 11/1974 | Fisher et al. . | |
| 3,866,382 | 2/1975 | Van Tassel | 182/128 |
| 4,058,184 | 11/1977 | Stuart | 182/128 |
| 4,232,636 | 11/1980 | Prohazka | 182/128 |
| 4,276,956 | 7/1981 | Mamula | 182/128 |
| 4,474,143 | 10/1984 | Wincze | 122/379 |
| 4,474,497 | 10/1984 | Sullivan | 122/379 |
| 4,535,727 | 8/1985 | Ziegler | 122/379 |
| 4,811,530 | 3/1989 | Eyerly . | |

*Primary Examiner*—Reinaldo P. Machado
*Attorney, Agent, or Firm*—Charles W. McHugh

[57] ABSTRACT

An apparatus for temporary installation within a relatively large pressure veseel, especially a boiler-furnace for generating electricity, for facilitating the manual inspection and (if necessary) the repair of things within said pressure vessel. The apparatus includes a generally horizontal platform upon which workers stand, and cables for raising and lowering the platform. The platform is fabricated from relatively small construction elements, each of which has a size that permits it to be inserted through a small access opening in the pressure vessel. The elements are manually assembled within the vessel by pinning them together, using high-strength pins which engage a plurality of prepared aperture. A relatively large platform is constructed in a vertical mode, and subsequenctly rotated to its horizontal and working orientation. In the preferred construction, adjustment of elevation of the platform is accomplished with an electro-hydraulic system which uses hydraulic fluid that is pressurized on the roof of the pressure vessel and utilized by winches mounted on or near the platform. After the vessel has been suitably inspected and repaired (as necessary), the platform is removed in the reverse order in which it was installed; personnel are removed from the platform and it is tilted back to a vertical orientation. Segments are then progressively removed from the lowermost edge—until all of the platform is disassembled and the construction elements have been individually removed through the small access opening. The cables are then withdrawn through the roof of the vessel.

15 Claims, 5 Drawing Sheets

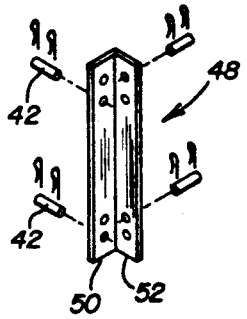
FIG. 5
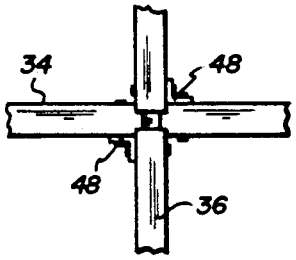
FIG. 6
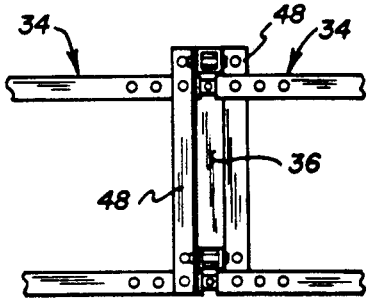
FIG. 7
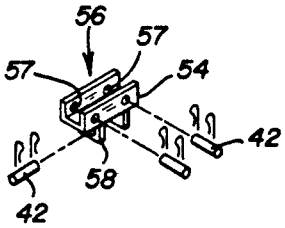
FIG. 8
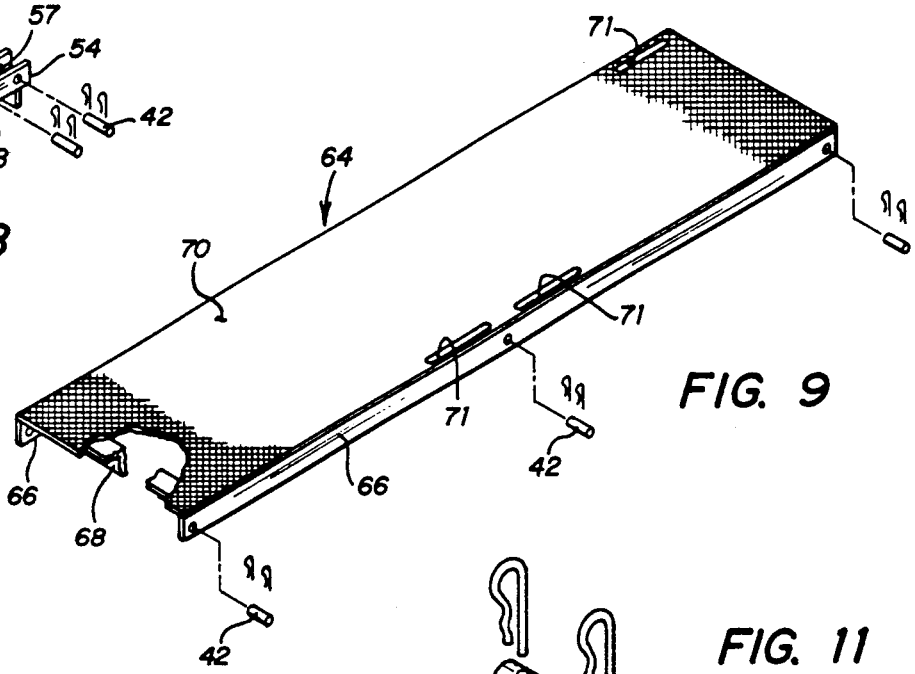
FIG. 9
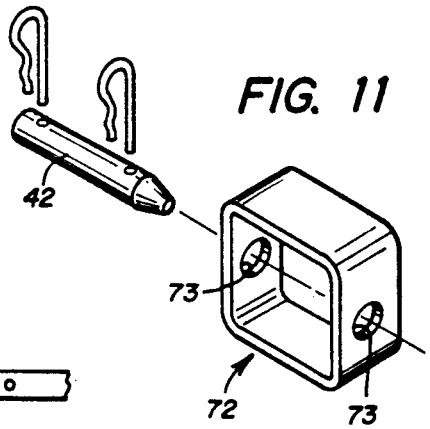
FIG. 11
FIG. 10
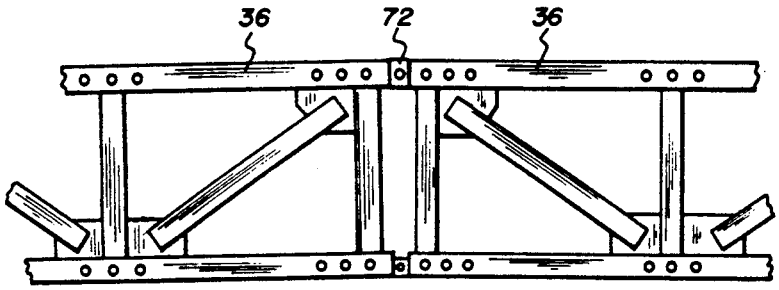

FIG. 12
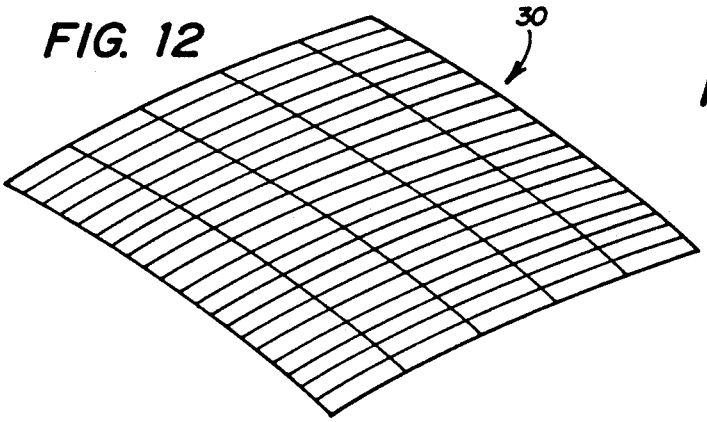
FIG. 13
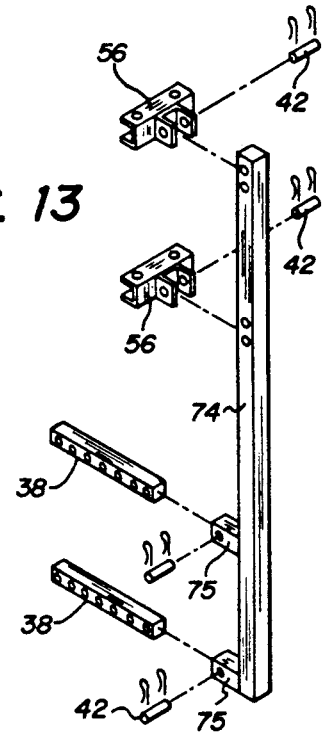
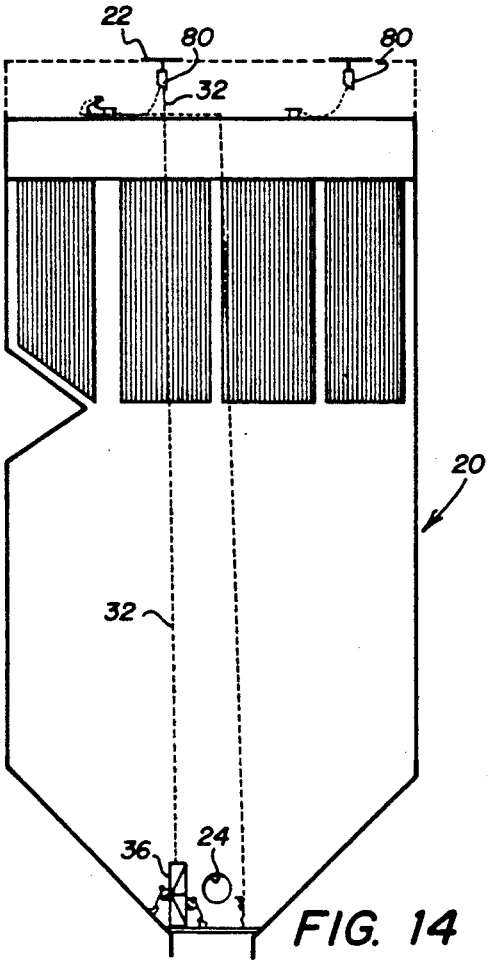
FIG. 14
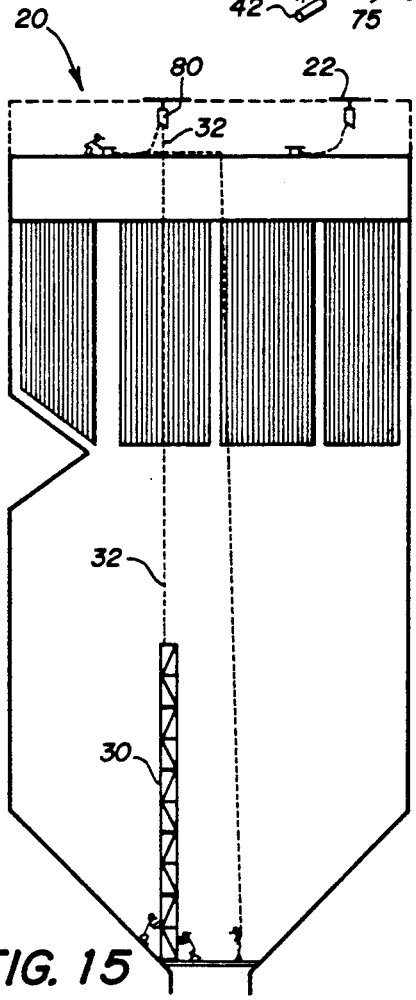
FIG. 15

APPARATUS FOR FACILITATING THE INTERNAL INSPECTION AND REPAIR OF LARGE PRESSURE VESSELS

BACKGROUND OF THE INVENTION

This invention relates generally to a method and apparatus for facilitating both the visual and physical examination of the inside of a relatively large pressure vessel; more specifically, it relates to the temporary installation of a vertically movable platform (having some of the characteristics of an elevator) inside a large pressure vessel, especially a coal-fired boiler-furnace used in generating electricity.

There are many instances in which it is either desirable or necessary for humans to be able to get into a large pressure vessel for the purpose of making a personal examination of things inside the vessel, e.g., the condition of the vessel walls or internal structural members and the like. One of the more common instances in which this kind of examination is necessary can be found in the electrical power industry where large boilers or furnaces are used to generate steam for driving turbines. Such boilers are often 80 to 160 feet high, 50 to 60 feet wide and 60 to 80 feet long. But because such vessels must be pressurized in order to be efficient, the access opening through which inspectors or repairmen must crawl in order to get into such large boilers is frequently on the order of only about 2 feet by 2 feet.

In the prior art, it has been common to pass numerous pieces of relatively small but specially configured sections of steel tubing through a boiler access door, and to then connect that tubing together in such a way as to form what is usually called scaffolding—to establish a rigid framework upon which workers may climb in order to reach elevated spots within the boiler. Regrettably, this technique has not been wholly satisfactory, primarily because it consumes a great number of man-hours and material simply to permit an inspector or repairman to gain access to an elevated location. Probably one reason for the absence of enthusiasm about the technique of using steel scaffolding is that it often takes about two weeks to construct a scaffold inside a large boiler in order to get workmen all the way to the top of a space that is, say, 80 foot tall; a similar two weeks is required to disassemble the scaffold and return the boiler to a clear and operative condition. But even though such portable steel scaffolding has not been favored, it has been used for many years because there was no real alternative that was available.

Another statistic will perhaps be particularly meaningful in evaluating the typical four-week construction time for installing and removing a scaffold in an average boiler, namely, the cost to a utility for having a large boiler out of service. The typical cost for even having a boiler on site and available to generate power is often over $100,000 per megawatt hour—whether the boiler is generating power or not. (This is because of the fixed costs associated with such a large piece of mechanical equipment, including design costs, "operating" salaries, taxes, general overhead, insurance, interest on loans, etc.). Additionally, if a particular utility has one of its units out of service and needs to turn to the national network in order to buy power—to replace the power that it is not able to generate itself, that substitute power is currently purchased at many thousands of dollars per megawatt hour. Very quick and simple arithmetic should make it apparent, therefore, that any kind of a shutdown of a large boiler can quickly become very expensive for a power company.

Besides the economics of wanting to quickly inspect and repair a boiler, there is also the concern for safety of the personnel who must accomplish the work within a typical power plant boiler. Safety for workmen is also a major factor to be taken into account when constructing scaffolds of the prior art, because such boilers typically have a very small floor area that is located at the bottom of a V-shaped region below the burners. And this small floor area is not even completely flat and homogeneous, because it typically includes space for an auger mechanism that is adapted to receive the ash and slag that usually accumulate in the bottom of coal-fired boilers. But while the floor may be only a few feet wide, the area to be encompassed by a work platform at, say, the 80-foot level, is often about 3,500 square feet. The result is that a scaffold must be constructed in such a way that it almost has the appearance of an upside-down pyramid; and it is very difficult to construct a temporary but dependably safe structure within a boiler when the operating parameters are such that the foundation is so much smaller than the superstructure. Perhaps it is for this reason that professional engineers are so reluctant to certify the safety of such temporary structures.

Those who are familiar with the history of art will perhaps recognize that the metal scaffold that has been described above is very similar to the scaffold system that was used by Michelangelo starting in 1508 when he was making preparations to paint the frescoes on the ceiling of the Sistine Chapel. So the concept of using a scaffold-type supporting frame has probably been around for perhaps 500 years or more. When a person learns that maintenance personnel in a modern boiler-furnace are still using a technique that was used by Michelangelo in Rome in the 16th century, one might well ask whether anything else has ever been tried. The answer is "Yes, that several things have indeed been tried, but with no real success." For example, U.S. Pat. No. 4,232,636 to Probazka entitled "Maintenance Platform Built Upon Retractable Support Beams" states that access to the elevated superheater in a boiler-furnace has been attempted by suspending work platforms on cables anchored in the furnace roof. But Probazka reports that such platforms are unsteady and that workers tend to become uncomfortable on them, especially when the platforms are suspended as much as 100 feet above the furnace floor.

Perhaps one reason that the "prior art" platforms described by Probazka were not successful is that maybe they were too much like a freely hanging swing that is suspended from a tree limb, rather than a platform having at least some control features. In any event, the construction proposed by Probazka in his 1980 patent proved to be equally unsatisfactory. A maintenance platform embodying his principles was constructed and tried at a power plant owned by Georgia Power at Plant Bowen, Ga. in 1980; it was rejected by the utility as unworkable when the rollers jammed and the beams could not even be launched to cover the relatively short distance that is illustrated in Probazka's FIG. 1.

But even if the maintenance platform in accordance with the Probazka design could be successfully launched, and if the law of gravity could be negated in such a way that the distal end of a heavy cantilevered beam could be caused to come to rest at the same elevation as the proximal end of such a beam, there are three major problems with such a fixed-level platform. First, such a platform is of necessity restricted to installation in a boiler at some elevation where there is room for storage of the platform when it is not in use. Probazka shows this location to be the "bullnose" of a boiler-furnace. This means that any maintenance work that would have to be done either above or below the bullnose would require the use of either ladders extending above or a traditional boatswain's chair hanging below such a platform. Second, in order to utilize a Probazka platform, at least one wall of a traditional boiler-furnace would have to be substantially modified in order to provide special doors for launching the platform. In particular, the water tubes which normally carry cooling water alongside the furnace walls would have to be eliminated in the spots where the doors are required. The absence of water tubes would contribute to localized hot spots in the walls, and fly ash could be expected to soon accumulate on the inside of the doors, probably to the extent that the doors would effectively become sealed shut from the inside (by the accumulated ash).

Third, the wooden decking shown by Probazka is designed to be installed one piece at a time, after a plurality of horizontal beams have presumably been projected across the narrow "throat" of the boiler-furnace. This may look all right on paper, but modern safety regulations prohibit the introduction of combustible materials (like Probazka's wooden planks) into a pressure vessel where workers may be using heavy-duty construction and repair equipment—like grinders and welders and other things that are likely to generate a spark. The prospect of a welder's torch causing a wooden platform to catch fire when men are in a furnace and working on the platform—and they have only a very limited form of possible escape—should make it quite evident as to why relatively light-weight but dangerous wooden planks have been outlawed by prudent managers.

After a maintenance platform in accordance with the Probazka concept was tried and rejected, a new maintenance platform was designed for use at the same Georgia Power plant, and its use was attempted in 1984. This "improved" platform attempted to overcome the inevitable sagging of the distal end of a cantilevered beam by attaching fixed cables to the projecting beams at their distal ends; the upper ends of the cables were attached to roof anchors. A platform in accordance with this new design was disclosed in U.S. Pat. No. 4,474,497 to Sullivan entitled "Furnace Maintenance Platform." However, a careful study of FIG. 2 of the Sullivan patent will reveal that it suffers from some of the same disadvantages of the Probazka design, namely, the inherent absence of cooling pipes in the regions where doors must be provided in order to launch the cantilevered beams. Also, it should be remembered that the furnaces being represented in the drawing are actually giant pressure vessels. Besides introducing potentially deleterious paths for the leakage of pressurized gases from an operating furnace, these doors are doomed to become sufficiently hot as to attract any hot (and therefore sticky) fly ash that is circulating in the furnace. And the fact that the maintenance platforms must be permanently mounted at a single, fixed location means that a Sullivan platform lacks the versatility that would be desirable for a maintenance platform.

When a platform in accordance with the Sullivan design was found to be unworkable also, still another proposal was made for providing access to the superheater tubes for furnace maintenance. The replacement design is shown in U.S. Pat. No. 4,474,143 to Wincze entitled "Retractable Maintenance Platform Stored Outside of the Furnace." In a Wincze construction the beams were designed to enter the furnace through especially constructed doors in an outwardly bulged furnace wall that could accommodate a beam that is lowered into the furnace with a generally vertical orientation. The theory was that a support cable attached to the distal end of a beam (as shown by cable 42 in Wincze's FIG. 4) could be pulled upward in order to cause the beam to tilt about a specially constructed slot 44 in a support member 46. This concept was tried by Georgia Power in 1984 and was also rejected as being unsuitable for use on the relatively large boiler-furnaces that are now customary in the industry. That is, it was concluded that even if the Wincze concept could be made to work at all, the dead weight of the steel beams and wooden deck in order to span a given work area would probably limit the platform area to a size of about 25 feet×25 feet. Such a small size might still be found in an old boiler-furnace having a rating of only about 200 to 300 megawatts; but attempts to improve operating efficiency have now produced modern boiler-furnaces which have generating capacities of three times that amount. Indeed, the average span in a modern boiler-furnace is about 80 feet. It will be seen, therefore, that concepts that have been proposed for old, small boiler-furnaces have been tested in practice and found to be unworkable; and there is no way that a steel platform for bridging a small space could be sized upward to cover the large areas in modern boiler-furnaces. There has therefore remained a need for an improved maintenance platform which is not limited in the area which it may encompass and which does not require any modification to the walls of the boiler-furnace in order to accommodate the platform. It is a primary object of this invention to teach such a new platform.

Another object is to provide at least some of the advantages of a fixed and stable elevator in a building without at the same time introducing those properties of an elevator that would render it unsuitable for boiler or furnace use. For example, U.S. Pat. No. 4,535,727 to Ziegler entitled "Heat Exchanger With Adjustable Platform For Cleaning And Repairing" shows that an elevator-type platform can be permanently placed inside a large pressure vessel. But such a permanent platform is obviously fixed in size and location, and hence can only provide access to the area immediately adjacent the small platform. If an attempt were to be made to transfer this concept from a heat exchanger to a boiler-furnace, and if the platform were to be made large enough to cover the underside of a boiler-furnace superheater (so that workers could have access to the entire superheater for inspection, maintenance or repair), then the presence of the elevator—for only occasional use—would completely negate the normal operation of the boiler-furnace. That is, the combustion of fuel in the lower portion of a boiler-furnace would not be effective in heating water-filled tubes above the furnace region if the elevator platform serves as a physical barrier to the efficient exchange of heat.

Furthermore, a permanently mounted platform as shown by Ziegler could never be accepted for use in the United States in boiler-furnaces, because regulatory agencies like OSHA that are charged with protecting the safety of industrial workers would never authorize it. Such a statement can be confidently made when it is appreciated that any elevator cables that were permanently mounted within a boiler-furnace would be exposed to the direct flames within a furnace and typical heat of perhaps 1700 degrees Fahrenheit; and there is no way that such cables could thereafter be sanctioned as "safe" for supporting humans (or carrying loads above humans) without first completely removing every one of the cables and testing them to make sure that they had not been damaged by the flames or become softened (annealed) from the heat of normal furnace operation. Even a cursory review of safety regulations like those published at 29 CFR XVII Sec. 1910.66, Subpart F should make it abundantly clear as to the amount of concern that regulators have for the safety of suspended platforms. It would obviously be self-defeating to permanently mount an elevator-type device in a boiler-furnace but then be forced to remove all parts of it complete inspection and testing before using the elevator in the manner that was intended. It follows therefore that what is needed is a work and inspection platform that can be safely stored outside a boiler-furnace when the boiler-furnace is being used to generate electricity, etc. On the other hand, such a platform must be capable of being quickly and reliably installed inside a boiler-furnace when such a structure has been shut down and has cooled enough so that it is safe for humans to enter it. It is an object of this invention to provide such a platform.

BRIEF DESCRIPTION OF THE INVENTION

In brief, this invention includes an apparatus adapted for temporary installation within a relatively large pressure vessel, especially a boiler-furnace for generating electricity, for the purpose of facilitating the manual inspection and (if necessary) the repair of things within said pressure vessel. In concept, the apparatus may be though of as analogous to a cable-operated elevator, in that it includes a generally horizontal platform upon which men may stand and work, and a plurality of cables for selectively raising and lowering the platform to meet the requirements of workers on the platform. The apparatus is particularly adapted for use in large pressure vessels such as steam boilers used in the generation of electricity, because it can be quickly installed within a boiler housing in order to permit workers to get close enough to the steam tubes and boiler walls to efficiently do their work—without requiring the fabrication of a major supporting structure having the characteristics of fixed scaffolding (sometimes also called staging).

The apparatus includes a platform fabricated from relatively small construction elements, each of which has a size that permits it to be inserted through a small access opening that is always provided in a large pressure vessel, usually in a section of the wall near the bottom of the vessel. After the construction elements are passed through the access opening, they are manually assembled within the pressure vessel by pinning the elements together, using high-strength pins which engage a plurality of prepared apertures in the construction elements. The construction elements are preferably made of light-weight, high-strength aluminum, and they are sized so that they may be readily brought into alignment by a construction crew using mostly if not entirely manual labor. In order to fabricate a platform that is significantly larger than the working area in the bottom of the pressure vessel, the platform is constructed in a vertical mode, and it is sequentially raised (using cables suspended from the roof) by discreet increments as each new segment of the platform is constructed at the "bottom" thereof. Of course, the "bottom" of the platform during the course of construction becomes one edge of the platform when it is subsequently rotated to its horizontal and working orientation. For both safety and ease of construction, as well as safety of operation, the platform is preferably assembly without the use of any bolts or equivalent threaded fasteners. In the preferred construction, adjustment of the elevation of the platform is accomplished with an electro-hydraulic system which uses hydraulic fluid that is pressurized on the roof of the pressure vessel and utilized by winches mounted on or near the platform itself, with the hydraulic pumps and winches being connected by hydraulic hoses of an appropriate length.

After the inside of the pressure vessel has been suitably inspected and repaired (as necessary), the platform is removed from the pressure vessel in the reverse order in which it was installed; that is, personnel are removed from the platform and it is tilted back to a vertical orientation. Segments are then progressively removed from the lowermost edge—until all of the platform is disassembled and the construction elements have been individually removed through the access opening near the bottom of the boiler wall. The cables are then withdrawn through the roof of the boiler and the boiler is thereby returned to its operative condition. The temporary installation and removal of such an apparatus can usually be accomplished in only a few days, in contrast to the several weeks that are often required with scaffold systems of the prior art.

DESCRIPTION OF THE FIGURES OF THE DRAWING

FIG. 5 is a perspective view of a vertical stabilizing element, shaped somewhat like a piece of common angle iron, which is provided to transfer some of the vertical loading from one truss to an adjacent truss;

FIG. 6 is a top plan view of a joint between four adjacent trusses, the trusses being shown in only a fragmentary manner;

FIG. 7 is an elevational view of the joint shown in FIG. 6, and showing one of the vertical stabilizing elements installed at the left side of the truss joint;

FIG. 8 is a perspective view of a bearer seat that aids in transferring loads from a horizontal deck to the vertical trusses, as well as supporting the hand-rail assembly around the periphery of the platform;

FIG. 9 is a perspective view of a deck panel that is designed to be pinned to the top of a group of trusses that have been assembled to create a bay of the platform;

FIG. 10 is an elevation view of two truss members showing the insertion of a spacer between the top runners, for the purpose of increasing the length of the top portion of the platform and giving it an upwardly bowed configuration;

FIG. 11 is a perspective view of a suitable spacer of the type shown in FIG. 10, and a pin that can hold the spacer in its operative position;

FIG. 12 is a perspective view of a work platform with its top being bowed upwardly because of extra length that is built into the top of the assembled trusses, in both major and minor truss directions (i.e., longitudinally and transversely);

FIG. 13 is a perspective view of a hand rail post that is oriented vertically when the platform is horizontal, and which is pinned to the platform so as to be movable therewith at all times;

FIG. 14 is a schematic drawing of a large pressure vessel that is about to be inspected and, if necessary, repaired by workmen within the vessel, and showing one of the preliminary steps to achieving a temporary work platform within the vessel;

FIG. 15 is a view similar to FIG. 14 and showing the progress of the platform as bays are assembled at the floor of the vessel and progressively raised into the open space with the vessel;

DETAILED DESCRIPTION OF A PREFERRED EMBODIMENT

Figure 1:
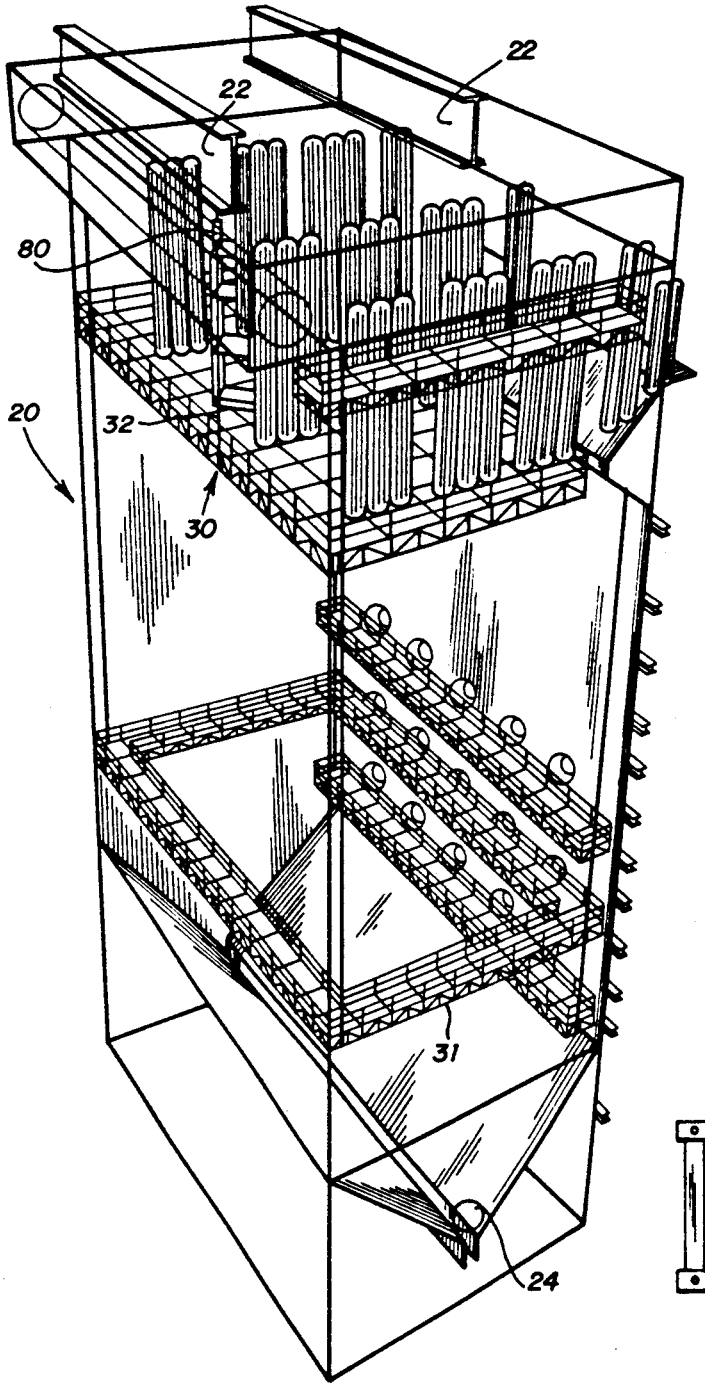
FIG. 1 is a perspective view of a large pressure vessel, shown in a somewhat simplified form and also shown partially broken away—to indicate at least one environment in which the invention is expected to find utility.

Referring initially to FIG. 1, a pressure vessel in the form of a large steam boiler 20 is shown in its typical, upright orientation—where it hangs suspended from an elevated steel structure having a plurality of I-beams 22. In a sense, such a large boiler 20 may be through of as analogous to a large balloon that is suspended from an overhead support structure. This technique of supporting a boiler from its top is employed, for one reason, because of the substantial temperature difference between parts at ambient temperatures and operating temperatures (which can often be 1,700 degrees Fahrenheit). And, the height of a boiler at ambient temperature and at operating temperature may vary by as much as a few feet. Another characteristic about such boilers is that any access hole which is provided for letting workers pass into and out of a cool boiler 20 is ideally made relatively small, so that the hole can be sealed with greater ease and structurally reinforced with greater reliability. A typical access hole 24 shown near the bottom of the boiler 20 will have dimensions of about two feet by two feet. Any working materials for inspection or repair of a boiler must therefore be of a size to pass through such a relatively small opening. Pressure vessels other than boilers are similarly provided with diminutive openings, and so the boiler 20 will hereinafter be referred to as being representative of any and all large pressure vessels.

At the top of the boiler 20 are a plurality of steel tubes which carry water into the boiler and which convey steam out of the boiler—where it is employed to drive a turbine for generating electricity, etc. The height of a typical coal-fired boiler for generating 600 to 700 megawatts will often be 160 feet, with a relatively clear space between the burners at the bottom of the boiler and the water/steam tubes at the top thereof. Other pipes are present around the sides of the boiler for the purpose of carrying a cooling fluid, usually water, which prevents the heat in a combustion chamber from doing significant damage to the walls of the boiler.

From time to time it is necessary to shut down operation of such massive boilers for the purpose of inspecting the multitude of pipes therein, so that their structural integrity may be confirmed and so that any pieces of slag adhering to an interior wall might be knocked loose. The costs to take a boiler off-line can be very expensive to a utility, because the power generated by turbines associated with a large boiler will often have to be purchased at the current rate for electricity to companies that are tied in to the national power grid. The cost to purchase replacement power is many thousands of dollars per megawatt hour, but of course any figure is subject to adjustment (more often upward than downward) as fuel costs change, etc. Therefore, any inspection or repair technique that involves removing a particular boiler from service will be of great interest to those persons involved with budgeting utility costs.

In the prior art, it has been customary to fabricate what can only be described as a monstrous framework of steel tubing (i.e., scaffolding or staging) within a boiler, on a temporary basis, for the sole purpose of permitting inspectors and workmen to reach the inside walls of a boiler—from the bottom to the top thereof. As might be suspected, there are only a certain number of workers who can be efficiently placed within a shut-down boiler for the purpose of erecting scaffolding; and it is not uncommon for at least two weeks to be consumed in constructing a framework of scaffolding that is about 100 feet high. Anything that can reduce this consumed time should naturally find favor with budgetary personnel and prudent management.

Figure 3:
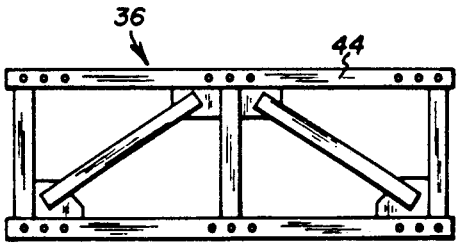
FIG. 3 is a front elevational view of another truss that is useful in making up the platform to a size that can essentially span the entire open space in the pressure vessel—or any desired portion of that space.
Figure 2:
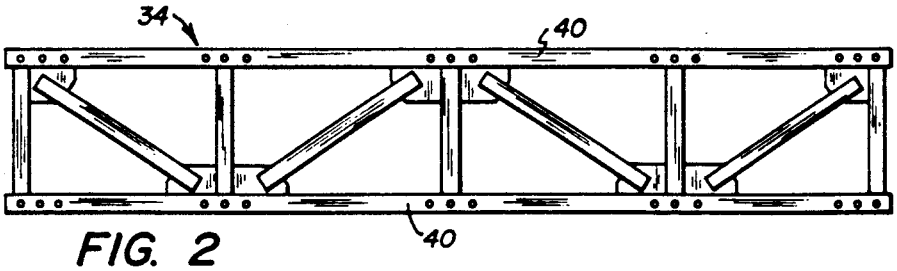
FIG. 2 is a front elevational view of an exemplary truss which is used to fabricate a platform inside a pressure vessel like that shown in FIG. 1, the platform being adapted to be suspended from cables that are temporarily mounted to hang from the roof of the pressure vessel.

In accordance with this invention, the erection of a scaffold within a boiler, from the bottom up, is completely eliminated. Instead, a platform 30 is built within the shut-down boiler and temporarily suspended by sturdy steel cables 32 from I-beams 22 at the roof of the boiler. The platform 30 is ideally fabricated in such a way as to cover most, if not all, of the area that corresponds to the open space within the boiler 20. Such an area can often be about 50 feet by 70 feet, or 3,500 square feet. To fabricate such a large structure within a boiler, a plurality of construction elements are naturally accumulated outside the boiler and then individually passed through the relatively small access opening 24 in the boiler wall. A manageable length for parts which two men can comfortably handle within the cramped space inside a boiler is about 8 feet. Therefore, truss elements 34 (FIG. 2) having a length of about 8 feet and a width of about 2 feet are commonly employed. Four of these main truss elements 34, when assembled in the shape of a square, create the major building block of the platform 30; and this discrete assembly will sometimes be referred to herein as a full bay. If the length or width of a given boiler is not divisible by 8, shorter truss elements 36 (FIG. 3) having a length of about 4 feet are advantageously used to adjust the width or length of the platform 30 by "half-bay" increments.

While the platform 30 will obviously need to be oriented in an approximately horizontal direction for efficient use by workers, in accordance with this invention the platform is constructed with a vertical orientation and then rotated to a horizontal orientation after it has been at least mostly completed. With such a building technique, all of the construction elements may be manually handled at a conveniently low working level, and relatively few, if any, things need to be hoisted by ropes or the like to an elevated position. To this end, all of the structural elements of the platform are designed so that they may be fitted together and locked to form "secured" or engaged bodies, regardless of their orientation. Expressed in other words, a platform in accordance with this invention could conceivably be picked up by some kind of an imaginary giant, and shaken or even turned upside down—without causing any of its components to fall off of the assembled platform. This is because all of the structural components are pinned together, and all of the pins are precluded from falling out of their respective holes by spring-latched safety clips, sometimes referred to as grenade clips. And there is no dead-weight loading on the pins that could cause the safety clips to come loose.

Figure 4:
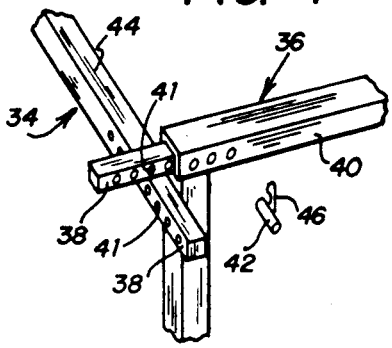
FIG. 4 is perspective view of a fragment of a platform and showing the technique for splicing together adjacent trusses, using an internal splicing element with a hole pattern that permits more than one dowel pin to be connected to each of the elongated runners of each truss.

The goal of creating a completely "secured" platform 30 is achieved by using a connecting system which will now be described, with initial reference to FIG. 4. A first truss member 34 is positioned so that it intersects a second truss member 36 to form a 90 degree angle; and it will be assumed that similar truss pieces are to be connected to these first-named elements so as to extend in either parallel or perpendicular directions. The truss member 34 (which some persons might refer to as a built-up beam) is fabricated from two elongated runners 40 made from 2 inch×2 inch×⅛ inch aluminum square tubing. The two parallel runners 40 are joined by welding appropriate lengths of vertical and inclined pieces of similar tubing, leaving the interior of the runners unobstructed so that splice bars may later be inserted into the ends of the runners. A splice bar 38 has a square cross-sectional shape and is sized so that it will fit snugly into the main runners 40 for a suitable distance. The preferred splice bar 38 has a length of about 18 inches, such that it can extend into each of two aligned runners 40 for a distance of about 9 inches. In FIG. 4, the second truss that is destined to be connected in line with the illustrated truss 34 has been omitted, of course; so approximately half of the splice bar 38 is shown in this figure as extending outwardly into empty space. In practice, this protruding portion of splice bar 38 will be telescoped within the aligned runner of an adjacent bay.

Another thing that will be apparent in FIG. 4 is the plurality of prepared holes 41 that extend through splice bar 38. These parallel holes 41 are sized to receive the hardened locking pins 42 with at least a slip fit. In fact, in the preferred embodiment, the holes 41 have a nominal diameter of 11/16 inch and the pins have a nominal diameter of ⅝ inch, such that there is a clearance of about 1/16 inch around each pin. Such a clearance makes it relatively easy to align a matching hole pattern in the runners 40 and the splice bars 38. This ample clearance also fosters a certain degree of flexure between different parts of the platform, so that the platform is essentially precluded from ever being put into such a bind as to create an unwanted and potentially harmful stress in any part of the platform. This premeditated and built-in potential for flexure is especially important because the preferred material for the entire platform 30 is aluminum, and aluminum parts have more inherent flexure than do similar parts made of steel or the like. Besides being relatively lightweight, the aluminum provides an excellent ratio of strength to weight, when material equal to 6061-T6 aluminum stock is utilized to fabricate the various construction elements.

In addition to the splice bar 38 extending outwardly from runner 40, a similar splice bar 38 is partially inserted into runner 44, which is an integral part of truss element 36. One or more pins 42 are inserted through prepared holes in runner 44 and secured in their installed positions with safety clips 46 that are positioned in transverse holes in the ends of the pins. In their preferred form, the pins 42 do not have a head on either end (as would be normal with a bolt); instead, the pins simply have two transverse bores or "pin" passages, with one passage being adjacent each end of a given pin. To facilitate convenience in installing and removing the pins 42, they may therefore be inserted into or removed from operative engagement with associated trusses from either side of a truss. However, to foster ease in inserting the pins 42, at least one end may be advantageously tapered so as to make it slightly pointed.

FIG. 4 shows two representative trusses 34, 36 joined together to form part of one bay of a platform 30. And these two trusses 34, 36 are shown so that their upper runners 40, 44 are immediately next to one another, although at slightly different elevations. While this is fine for illustration purposes, there is nothing structural that is shown in this particular figure for physically holding these two trusses in their relative positions. Turning next to FIG. 5, the element which securely holds these trusses with respect to one another, at least as far as their elevation is concerned, is a bracket (or stabilizing angle) 48 having an L-shaped cross-section formed by two flanges 50, 52. In one flange 50 are provided four holes that are arranged as two pairs of spaced holes, with both of the pairs being 1 foot, 4 inches apart and both pairs being adapted to receive pins 42 which connect the bracket to one of the trusses, e.g., truss 34. The other flange 52 also has two pairs of spaced holes for receiving more of the same high-strength pins 42, to connect the bracket 48 to the other truss, i.e., truss 36. The length of each of the pins 42 is preferably about four inches, which is long enough to pass through the flanges of two juxtoposed brackets 48 and one segment of a runner 40 or runner 44. This length permits four such brackets 48 to be placed around a given joint where four bays are connected together, when substantial strength is needed for a particularly large platform; but two diagonally positioned brackets (as shown in FIG. 6) will usually provide enough strength for most platforms. FIG. 7 shows the same joint in elevation view, and clearly shows the vertical spacing between two aligned trusses 34 (that form a part of one of the platform's major trusses) and a transverse or minor truss made up of trusses 36. FIG. 7 should also make it apparent as why two pairs of holes are provided on each flange, i.e., so that a bracket 48 can be placed on either side of a joint and with either end up.

Having now described the interconnection of the truss members 34, 36 which make up the primary structural parts of the platform, the relatively thin panels upon which workers will eventually walk will now be described. As suggested earlier, it is believed to be very important that these panels (which are horizontal when the platform is horizontal) be mechanically coupled or "secured" to the trusses, in order that they cannot possibly become loose or misaligned as the platform is tilted or moved. Given this design objective, there must of necessity be some way of mechanically connecting the panels to the trusses. The first element in the preferred construction constitutes a bearer seat 56 formed from two sections of oppositely oriented and transversely arranged channels (FIG. 8). The upper and longer channel 54 has two sets of transverse holes 56 for use in achieving a fixed connection with rails on the deck members (to be described). The lower and shorter channel 58 has two aligned holes that are provided at the proper location to receive one of the heat-treated pins 42; matching holes are drilled transversely through the middle of the upper runners 40 of truss elements 36. When the bearer seats 56 are pinned to the tops of the major trusses, they provide a mid-truss support for the bearers 62 that are included to provide additional support for the deck members.

Turning next to FIG. 9, a panel or deck member 64 is comprised of two elongated and parallel rails 66 which are rigidly joined by a plurality of welded cross members 68, typically six. Such a deck member 64 provides the requisite strength to support an aluminum tread plate 70 which is adapted to be placed directly on and welded to the top of the deck frame. The preferred tread plate 70 is 3/16 inch solid aluminum plate, having a strength equivalent to 6061-T6. With this construction, relatively thin deck panels upon which workers can perform their respective functions can be physically locked to the truss members of the platform with pins 42, even while the platform is being constructed and while the platform is vertically oriented. And as new segments are added to the platform at its lowermost edge, the platform can be raised in eight-foot increments (which is the length of a preferred deck panel), and workers need have no fear of any elements falling away from an upper portion of the platform.

With regard to the use of solid tread plates, perhaps it should be mentioned that lighter materials are obviously available. (The preferred solid tread plate weighs about 3 pounds per square foot.) But it has been found to be advantageous to use solid plate for the tread plate 70, and to weld the plate to the braces under the plate. This manufacturing technique substantially increases the rigidity of the deck members 64 and, hence, the rigidity of the work platform 30—after the deck members are structurally fixed to the tops of the trusses 34, 36. It also increases the durability of the deck members when they are being manually handled outside the pressure vessel. This is important because careless and rough handling of components in moving them to and from storage (when they are not in actual use) could conceivably cause more harm than prolonged use in a proper manner inside a pressure vessel.

Another thing that is advantageous in improving the load-carrying ability of the platform 30 is to configure it in such a way that it will be bulged upward slightly—in its center—before any significant loads are placed on it. By designing and fabricating the platform 30 so that it has a slight upward bulge (or arch) before it is suspended by cables 32 and then loaded with men and equipment, the platform will have more load-carrying ability because it will not experience a deleterious sag in its center when it it is suspended by cables that may have to be connected close to the periphery of the platform. Even when fully loaded as anticipated, the horizontally suspended platform 30 can still advantageously have a very slight upward bulge or camber; but such a camber, if present, will usually not be large enough to even be perceptible to most persons. In most cases the loaded platform will appear to be exactly flat when it is examined in an elevational view, and it may even actually be flat. What is to be avoided, if at all possible, is a loaded platform with a sunken middle, such that a cross-sectional view of the platform would have a concave appearance.

Achieving a generally convex shape in the platform 30 can be accomplished in accordance with this invention by adding one or more spacers 72 between linearly aligned runners at the tops of the trusses—but omitting such spacers between the lower runners, as shown in FIG. 10. The spacers 72 are held securely in their intended positions by pins (e.g., pins 42) that pass through two aligned apertures 73 (FIG. 11) in two sides of the spacer and the central aperture of a splice bar 38. The unique 7-hole hole pattern of the splice bar 38 permits installation of a spacer like spacer 72 without affecting the function of the bar 38 in connecting the trusses together to form a sturdy work platform. Ideally, the extra length that is imparted to the top series of runners is accomplished by distributing a plurality of relatively small spacers 72 along the full length of the aligned truss members, rather than inserting one large spacer at a single location somewhere along the top. This has the effect of distributing the extra length incrementally along the total length of the truss members. A suitable spacer 72 can be formed from 2×2 inch aluminum tubing having a one-eighth inch wall thickness, which is the same stock from which the runners 40 are made.

The length of a preferred spacer 72 is one and one-eighth inches, while the nominal gap between the confronting ends of two runners is only one inch. Using simple arithmetic, it might therefore be expected that a one-eighth inch "excess" would be created between trusses at every joint where a spacer 72 is provided. But it must be remembered that a generous hole tolerance has been built into the connection between the pins 42 and the transverse holes in the ends of the runners. Because of this generous hole tolerance, about half of the one-eighth inch "excess" will be effectively absorbed at the pin connections, with the result that only about one-sixteenth inch of excess length is actually realized for each joint. Thus, for each truss section having a length of eight feet, approximately one-sixteenth of an inch of extra length is built into the "top" through use of the spacers described herein.

By using the spacers 72 in both the longitudinal and transverse directions of the platform 30, the platform may be fabricated with a slight upward bulge as examined in both longitudinal and transverse directions; this will produce what may be referred to as a "crown" in its center. Such a "crowned" platform is suggested in the schematic illustration of FIG. 12, which is slightly exaggerated—to illustrate the point being made. If the spacers are used in only the longitudinal direction, the resulting platform will have a slight arch (depending upon its length) but only in one plane.

To foster safety for the workers that will be on the platform after it has been rotated to its horizontal orientation, a boundary structure is added to the platform 30 around its periphery. In order to minimize the number of unique parts that are required to fabricate a complete platform, two structural parts that have already been described are preferably used as components of the handrail system. These parts are the bearer seats 56 and the mid-truss bearers 62. To support these elements above the platform, a handrail post 74 (FIG. 13) is provided. In keeping with the modular concept of fabricating the platform 30, the post 74 has two arms 75 that are sized and positioned to mate with (i.e., telescope over) splice bars 38 that are inserted into those truss ends that are exposed at the periphery of the platform. The multiple holes in the splice bar 38 permit it to be inserted as far into a given runner as seems to be desirable, with the result that the handrail posts 74 can be placed essentially as close to the platform as seems to be needed. And because the handrail system is secured to the platform using removable pins 42, any section of the handrail can be removed at an appropriate time in order to let a piece of equipment extend over the side of the platform, or to expand a section of the platform, etc.

To utilize this invention to inspect and/or repair a steam boiler in a power plant, it will be customary for the owner of a power plant to schedule the downtime for the boiler and begin to assemble all of the necessary materials at the work site. Shortly after the boiler is turned off and "cool down" begins, a work crew of perhaps four or five men can move to the boiler roof for the purpose of mounting winch cables to the structural beams that are an integral part of the boiler's superstructure. Eye bolts may be advantageously used to rigidly secure the winches to the structural beams, and welded steel adapters may also be useful to facilitate a quick connection of the eye bolts to the beams. Two such winches 80 are schematically illustrated as being connected to I-beams 22 in FIG. 14. The preferred winches are electro-hydraulic winches manufactured by Hoist Industries Thun Ltd. of Thun, Switzerland, and identified as Model HIT-32 Champion rope tensioning machines. These winches 80 are very strong, dependable and capable of "pulling" any length of wire rope (i.e., steel cable) to which they are attached, for the purpose of lifting and supporting the platform. The winches 80 weigh only about 47 pounds each, but are capable of lifting over 8,000 pounds with ⅝ inch cable. Hence the winches are reasonably portable and can be handled by even a single worker on the roof of a boiler without the need for any cranes or other lifting devices. A drum of ⅝ inch cable that is as much as 250 feet long will obviously weigh much more than 47 pounds, but it too can be maneuvered on the roof of a boiler with ordinary moving equipment.

Once the winches 80 are installed, one or more workers on the roof begin to pull portions of the steel cables 32 off their respective supply reels on top of the boiler; these initial portions are passed through the gripping jaws of the respective winches. The free ends of each cable 32 may then be passed downward into the semi-cooled boiler through ports (or cable "doors") that constitute integral parts of the roof of a conventional large boiler. Typical cable ports are not especially large, and often are only a couple of inches or so in diameter; but they are usually widely distributed over the roof of a boiler, so an appropriately located port can usually be found with no difficulty. Enough cable is passed down into the boiler so that at least some of the cables 32 reach all the way to the bottom of the boiler, where the distal ends may be grasped by other workers and positioned for subsequent connection to the platform elements.

Before long, the interior of the boiler will have cooled to the point that a construction crew can gain access to the interior of the boiler through an access hole 24, usually near the bottom of the boiler in a sidewall. A temporary working floor is provided over the ash-collection trough in the bottom of the boiler, and the interior construction crew then begins the task of transferring the plurality of construction elements into the bottom of the boiler—in the order in which they are needed and on an "as required" basis. The first row of side-by-side bays will typically be assembled along the full length of the boiler bottom, using the pins 42 for connecting the truss elements together to create a strong but lightweight framework. With each bay of the platform (i.e., an 8 foot by 8 foot section thereof) resting directly on the floor of the boiler, the total dead weight of the apparatus on the floor of the boiler will be approximately 7 pounds per square foot, i.e., about 448 pounds per 8 foot by 8 foot bay. Of course, any components that are already in the boiler but not yet connected to the first row of bays will add their weight to the dead weight on the floor. But those skilled in the art will appreciate the relatively modest weight that is being applied to the bottom of the boiler at this stage; depending on the anticipated width of the platform, this is about as much weight as is ever applied to the bottom of the boiler. Any additional weight as a result of enlargement of the platform (as new segments are sequentially added to the lower edge thereof) is accommodated by the structural beams above the roof of the boiler. This is true because the steel cables 32 are very soon employed to transfer the platform weight off the floor and onto the I-beams 22.

Because the platform 30 is preferably made of aluminum structural pieces, and because aluminum is such a good conductor of electricity, prudence dictates that an effort be made to electrically isolate the platform 30 from any potential source of electrical current that might somehow pass downward through the steel cable 32. For this reason, the slings 33 which connect the lower ends of the steel cables 32 to the platform 30 are provided with an electrically insulating cover 35, preferably of rubber. If a customized rubber cover 35 is not readily available, a ¾ inch heavy-duty water hose may be placed around the mid-section of the sling before its ends are shaped and crimped—to form eyes for receiving a hook at the distal end of cable 32. By passing one of the slings 33 through prepared slots 71 in the tread plate 70 and around a truss, the partially completed platform is ready to begin its ascent into the cavernous space which constitutes the combustion chamber for a typical boiler. FIG. 15 shows five bays of a partially completed platform suspended vertically by a representative steel cable 32, with another cable ready to be attached to the "down" or lower end of the platform, so that the platform may be tilted upward by about 90 degrees to a horizontal orientation.

When appropriate ones of the cables 32 have been raised so that the platform 30 has been rotated by approximately 90 degrees, workers may climb onto the platform and begin to conduct their business. However, there is always a risk that workers may accidentally kick a tool or the like which is resting on a horizontal surface. In order to prevent that tool from accidentally being kicked off the platform where it might cause damage or injury to something or someone on the floor of the boiler, a kickplate 76 is preferably provided around the periphery of the platform. Also, the handrails are mounted on posts 74 to provide a physical barrier so that persons do not accidentally step beyond the platform (if there is any clearance space between the platform and the adjacent wall of a boiler).

After the platform 30 has been rotated to its horizontal position, inspectors can immediately begin a personal and proximate inspection of the cooling tubes which form the sides of the boiler as well as other structural features. Signals generated by personnel on the platform are given to personnel on the roof, to raise or lower the platform, as required, to accomplish their various tasks. The signals may be given by portable telephone or radio, in a manner that will be understood to those familiar with working with remotely operated equipment such as cranes. When desired, the platform may be selectively elevated by distances as small as an inch, by use of the preferred winches. That is, unlike the prior art where working stations were often rigidly established by the geometry of the scaffolding that was erected in a boiler, the platform of this invention may be selectively raised by relatively small increments and in any area within the boiler where suspended cables can provide the necessary overhead support. Elevation rates on the order of three to six feet per minute can be expected with the preferred electro-hydraulic units 82 and winches 80.

If inspectors determine that a particular area in the wall of a boiler needs major attention or repair, a secondary platform 31 may be fabricated and suspended below the main platform 30, in order that workers might remain at a fixed elevation while inspectors continue to work their way up the boiler walls. Such a secondary platform 31 could be as small as 4 feet by 8 feet, or it could be in the shape of an annular band extending about 8 feet wide around the entire interior of the boiler. Usually the auxiliary platform 31 could be suspended by its own cables from the I-beams 22, in the same manner as the main platform 30; with this technique, the auxiliary platform will be independent of any subsequent movement of the platform 30 above it. The slots 71 in the deck plates are, of course, wide enough to preclude any interference between fixed cables for an auxiliary platform 31 as the main platform 30 is raised or lowered.

Another distinct characteristic of the apparatus described herein is the hoist apparatus which is used to selectively raise and lower the platform within the pressure vessel. The winching system that is preferred for this invention is positioned on the roof of the pressure vessel, so that it does not add its own weight to the platform weight. Selection of the optimum hoisting unit described herein is based in part upon the fact that it is electro-hydraulic, so that an appropriate number of electrically powered hydraulic units 82 (i.e., pumps) may be distributed across the roof of the pressure vessel and mounted at convenient places. Flexible hydraulic lines then extend between the hydraulic power units 82 and the winching mechanisms 80 that are anchored at their upper ends to the steel framework above the boiler-furnace. Extending downward out of the bottom of the winches, of course, are the steel cables 32 which are used to temporarily suspend the platform 30 within the pressure vessel.

One advantage of the arrangement taught herein is that there is no necessity of extending high voltage electrical cables down into the pressure vessel; such cables would be necessary to provide electrical power to a hydraulic unit if the unit were to be physically carried by the platform. Such a "platform-mount" system would be more risky than the "roof-mount" arrangement being taught herein, because, among other reasons, it would obviously be catastrophic to shock everyone who might be in physical contact with a metallic platform which was accidentally shorted to a broken electrical cable. Another alternative that someone might consider would be to keep the electrically driven pumps on the roof but place the hydraulic reaction units (i.e., the winches) on or near the platform. This, too, would be less than ideal, because it would surely require very long, high pressure hydraulic hoses that would connect the pumps and the winches. Such long hoses would have to pass through apertures in the roof of the pressure vessel, where they would almost surely be subject to wear as they rubbed against portions of the roof; such hoses might also rub against any adjacent steel cables that pass through the same apertures and support the platform. And even if common sense did not dictate that a person should try to minimize the adverse consequences of something that could go wrong, federal regulations with regard to safety in the workplace would probably prohibit placing an electrically powered winch directly on the platform that serves as a working surface for a variety of maintenance people. For example, Subpart F of the Occupational Safety and Health Administration Rules that are found in 29 CFR Ch. XVII may be deemed to offer guidance for platforms of the kind contemplated herein, although it could be argued that this particular OSHA rule is concerned only with the exterior of a building or structure.

Figure 16:
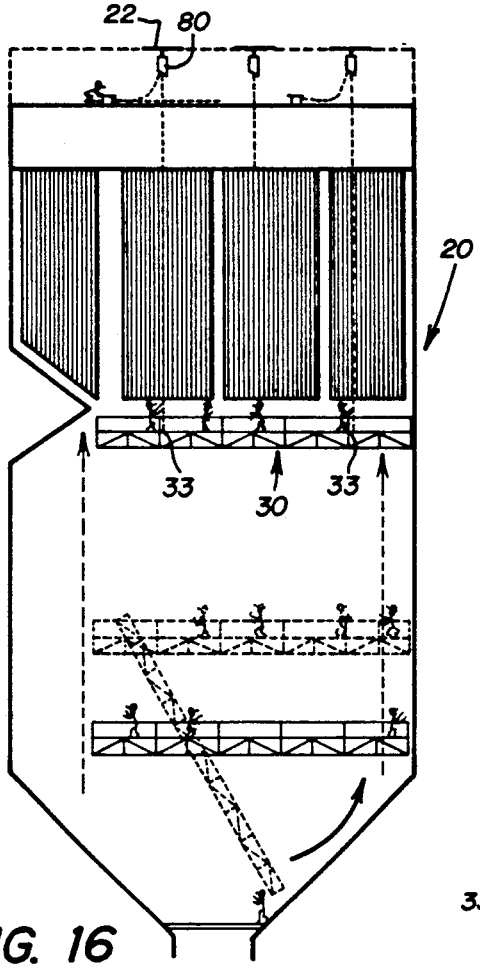
FIG. 16 is a view similar to FIG. 15 and showing the platform raised to a working position adjacent the boiler tubes which are located at the top of the boiler, with extra cables now attached to the platform to increase its load-carrying capacity.
Figure 17:
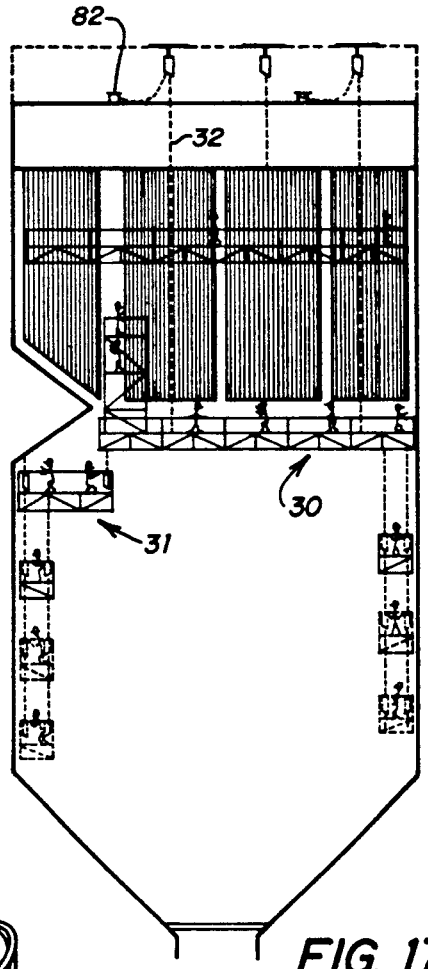
FIG. 17 is a view similar to FIG. 16 and showing auxiliary platforms independently suspended below the main platform, so that workmen might selectively have prolonged access to some particular place within the vessel—regardless of any up or down movement of the main platform.
Figure 18:
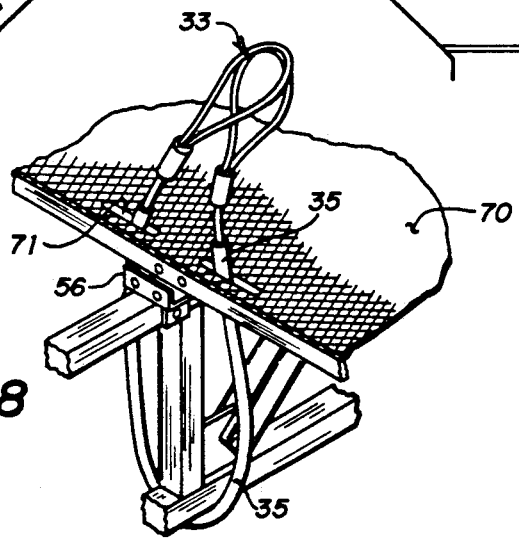
FIG. 18 is a perspective showing of an exemplary sling that is attached to the bottom end of a support cable, the sling also being wrapped around a truss member.
Figure 19:
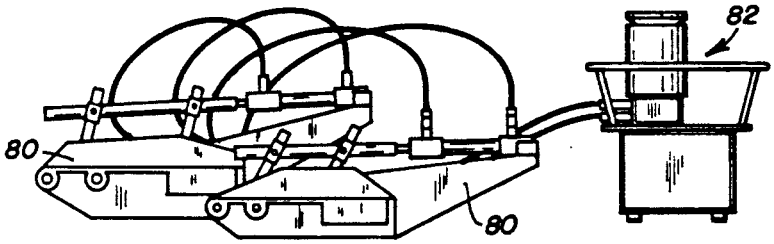
FIG. 19 is a perspective view of the preferred electro-hydraulic power unit which is connected to a hydraulically powered winch (or rope hoist)

FIGS. 14–17 show in a schematic fashion how the invention may be practiced; FIG. 16 in particular shows the addition of extra support cables that may be added to increase the load-carrying capacity of the platform after it has been rotated to a horizontal position and placed at a desired elevation. FIG. 18 shows one way of placing a sling 33 through exemplary slots 71 in a deck panel, and positioning said sling in such a way that it may be brought into a load-bearing relationship with a truss.

Figure 20:
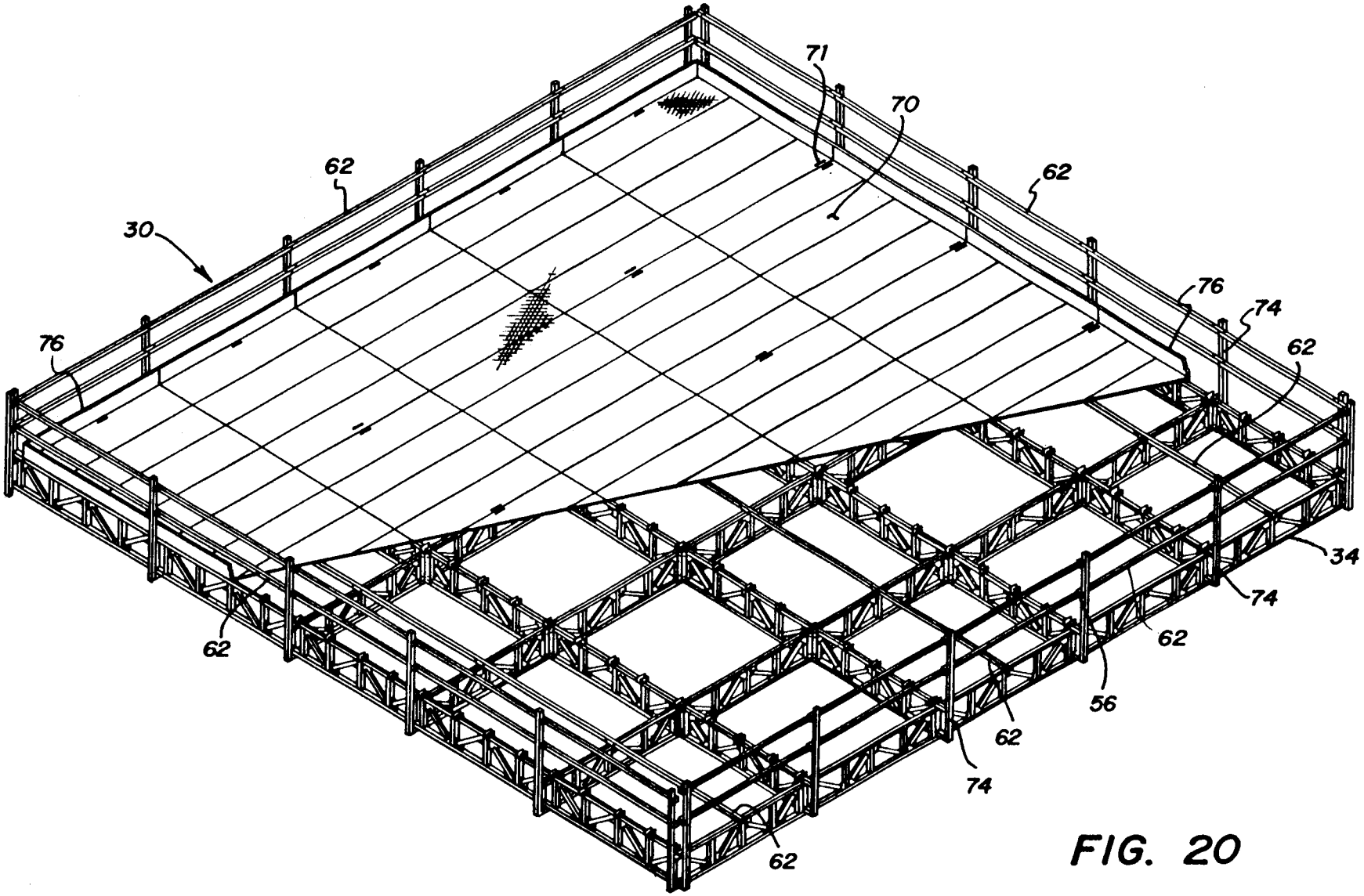
FIG. 20 is a perspective view of an exemplary work platform, with a substantial part of the deck being broken away to reveal the truss structure that is manually assembled within the vessel to support the deck.

FIG. 20 shows in greater detail what an exemplary platform might look like when it is completed inside a pressure vessel. Of course the pressure vessel need not be a large boiler-furnace; it could also be any other large structure where temporary access to the interior of the structure is needed, including containment vessels for nuclear power plants and the like. Therefore, the showings herein of a particular pressure vessel are not intended to be limiting; those skilled in the art should be able to recognize how the concepts can best be applied to individual situations. For example, if the pressure vessel that is to be examined and/or repaired does not have inherent provision for suspending vertical cables from the roof of the vessel, one or more temporary anchoring points may be created through suitable structural work inside the pressure vessel. Also, the preferred material for practicing the invention has been described as high-strength aluminum; but some other light-weight material might be substituted for the aluminum, if considerations such as price, shear strength, availability and strength-to-weight ratios seemed to justify a substitution. Also, the sizes of trusses, bays, and deck panels might be adjusted in order to fit one or more specific pressure vessels, rather than being sized (as shown herein) so as to be essentially universal in their suitability for all large boiler-furnaces. Indeed, it should be readily appreciated by those skilled in the art that many of the parameters recited herein are capable of being varied in accordance with the broad concepts that have been disclosed. Therefore, the invention should be understood to be limited only by the scope of the claims which are appended to this specification.

What is claimed is:

1. An apparatus having particular utility in serving as a work platform within a large pressure vessel such as a boiler-furnace for generating steam, such pressure vessels being of the type commonly found in power plants for generating electricity, and such pressure vessels having a top and a bottom and a plurality of side walls, and having a relatively small access hole near the bottom, and the size of the access hole being large enough so that a workman may crawl therethrough in order to gain entrance to the pressure vessel, comprising the combination of:

a. a plurality of metal trusses, each of which has a relatively short height and a length such that the trusses can be individually inserted through a relatively small access hole that is routinely provided near the bottom of a pressure vessel to admit workmen, and the trusses being configured for connection with each other in an end-to-end manner in directions that are both parallel and perpendicular to the length direction of a given truss;

b. a plurality of thin deck members configured to rest on top of the trusses to create a work platform when the trusses are oriented in a generally horizontal working position within the pressure vessel;

c. means for structurally connecting the trusses and deck members together inside the pressure vessel without the use of any tools; and d. cable means for selectively raising and lowering the work platform within the pressure vessel, including a plurality of steel cables adapted to be temporarily suspended from the top of the pressure vessel.

2. The apparatus as claimed in claim 1 wherein the means for connecting the trusses and deck members together includes:

a plurality of splicing elements adapted to fit interiorly of the ends of pairs of adjacent and aligned trusses;

a plurality of hardened pins configured to be inserted through prepared holes in the trusses, splicing elements and deck members for connecting the same together within the pressure vessel.

3. The apparatus as claimed in claim 2 wherein the hardened pins have small and transversely oriented bores near each of their two ends, and further including a plurality of wire-like safety clips configured for passing through the respective bores in the hardened pins, said clips being adapted for reliably securing the pins in their respective positions for connecting together the trusses, splicing elements and deck members, whereby the work platform can be assembled within a pressure vessel without the necessity of engaging threaded members such as bolt and nuts, and whereby the completeness and adequacy of a given connection between a truss and a deck member can be ascertained merely by visually confirming the presence of a pin and its associated safety clip.

4. The apparatus as claimed in claim 1 wherein both the trusses and the deck members are made of high strength aluminum having a strength at least as great as 6061-T6 aluminum.

5. The apparatus as claimed in claim 1 and further including means for connecting the assembled work platform to the steel cables that are suspended from the top of the pressure vessel in such a way that the work platform is electrically insulated from the steel cables.

6. The apparatus as claimed in claim 1 wherein the cable means includes electro-hydraulic power units and hydraulically powered winches located at the top of the pressure vessel.

7. The apparatus as claimed in claim 1 wherein each of the components that makes up the assembled work platform weighs no more than 70 pounds, whereby each of the components can be readily handled with manual labor.

8. The apparatus as claimed in claim 1 wherein the work platform has a top surface that functions as its working surface, and wherein the working surface is incrementally adjustable in increments of about 16 square feet, whereby the working surface of the platform may be sized to fit to within about 16 square feet of the space in a pressure vessel in which the platform is fabricated.

9. The apparatus as claimed in claim 1 and further including means for imparting a generally convex shape to the platform as seen in a cross-sectional view before the platform is loaded with men and equipment, and the top central portion of the platform is the highest when the platform is oriented horizontally.

10. The apparatus as claimed in claim 9 wherein the means for imparting a generally convex shape to the platform includes a plurality of spacers inserted between certain top runners of the truss members, said spacers being effective to make the total length of the top portion of the connected truss members longer than the bottom portion of the same trusses, whereby the top portion is forced to take on an arcuate shape.

11. The apparatus as claimed in claim 10 wherein a relatively small spacer on the order of one inch in depth is placed between essentially all of the top runners of a plurality of aligned truss members, whereby the requisite increase in total length is distributed in small increments across the total length of the truss members, each of which increments is about one inch long.

12. The apparatus as claimed in claim 10 wherein the spacers are arranged in a pattern such that about one-half of the spacers are oriented in a first direction with respect to the platform, and about one-half of the spacers are oriented perpendicularly to said first direction, whereby the platform will have an approximately uniform slope in all directions away from the center of the platform.

13. The apparatus as claimed in claim 10 wherein the spacers are fabricated from tubing having a cross-sectional configuration and size that is approximately the same as the top runners that form parts of the trusses.

14. The apparatus as claimed in claim 10 wherein the spacers have a pair of aligned apertures which are sized so as to permit the spacers to be pinned to a splicing element positioned between the top runners of two aligned trusses.

15. The apparatus as claimed in claim 10 wherein the spacers are fabricated from aluminum tubing having a nominal size of two inches by two inches and a wall thickness of about 0.125 inch, and the spacers have been heat treated to a strength equivalent to 6061 T-6 aluminum.

* * * * *